US007869729B2

(12) United States Patent
Hachisuka

(10) Patent No.: US 7,869,729 B2
(45) Date of Patent: Jan. 11, 2011

(54) FIXING DEVICE CAPABLE OF PROVIDING STABLE QUALITY OF FIXED IMAGE

(75) Inventor: Toshiharu Hachisuka, Yokohama (JP)

(73) Assignee: Ricoh Company, Ltd., Tokyo (JP)

( * ) Notice: Subject to any disclaimer, the term of this patent is extended or adjusted under 35 U.S.C. 154(b) by 135 days.

(21) Appl. No.: 12/216,292

(22) Filed: Jul. 2, 2008

(65) Prior Publication Data

US 2009/0016760 A1 Jan. 15, 2009

(30) Foreign Application Priority Data

Jul. 10, 2007 (JP) ..... 2007-180681

(51) Int. Cl.
*G03G 15/20* (2006.01)

(52) U.S. Cl. ..... 399/68; 399/69; 399/329

(58) Field of Classification Search ..... 399/329, 399/67, 68, 69, 328, 320; 219/216; 347/156
See application file for complete search history.

(56) References Cited

U.S. PATENT DOCUMENTS

| | | | | |
|---|---|---|---|---|
| 6,405,002 | B2 | 6/2002 | Ogiyama et al. | 399/101 |
| 6,459,877 | B1 * | 10/2002 | Yoda et al. | 219/216 X |
| 6,577,840 | B2 | 6/2003 | Hachisuka et al. | 399/329 |
| 6,865,363 | B2 | 3/2005 | Hachisuka et al. | 399/329 |
| 7,127,204 | B2 | 10/2006 | Satoh et al. | 399/329 |
| 7,313,353 | B2 | 12/2007 | Satoh et al. | 399/329 |
| 2001/0003562 | A1 | 6/2001 | Hachisuka et al. | 399/329 |
| 2001/0031159 | A1 | 10/2001 | Ogiyama et al. | 399/297 |
| 2002/0136562 | A1 * | 9/2002 | Hiroki et al. | 399/69 |
| 2003/0053830 | A1 | 3/2003 | Hachisuka et al. | 399/329 |
| 2005/0129432 | A1 * | 6/2005 | Sato et al. | 399/329 |
| 2005/0163543 | A1 | 7/2005 | Satoh et al. | 399/329 |
| 2006/0177246 | A1 * | 8/2006 | Kawada et al. | 399/301 |
| 2006/0263122 | A1 | 11/2006 | Hachisuka | 399/327 |
| 2007/0014603 | A1 | 1/2007 | Satoh et al. | 399/329 |
| 2007/0059003 | A1 * | 3/2007 | Shinshi et al. | 399/68 X |

FOREIGN PATENT DOCUMENTS

| | | |
|---|---|---|
| JP | 2004-117518 | 4/2004 |
| JP | 2005-156769 | 6/2005 |
| JP | 2005-301070 | 10/2005 |
| JP | 2008-139724 A * | 6/2008 |

* cited by examiner

*Primary Examiner*—Sophia S Chen
(74) *Attorney, Agent, or Firm*—Harness, Dickey & Pierce, PLC

(57) ABSTRACT

A fixing device fixes an image on a recording medium by applying heat and pressure. In the fixing device, a belt is looped over a heating roller and a first roller provided inside a loop formed by the belt. A belt tensioner is provided outside the loop formed by the belt to apply tension to the belt. A second roller presses the first roller via the belt to form a nip between the first roller and the second roller via the belt. A holder holds the first roller and the second roller to maintain a distance between the first roller and the second roller. A detector detects a position of the belt tensioner. A controller changes a control parameter for fixing the image on the recording medium at the nip when the recording medium passes through the nip according to a detection result provided by the detector.

20 Claims, 7 Drawing Sheets

FIXING DEVICE CAPABLE OF PROVIDING STABLE QUALITY OF FIXED IMAGE

PRIORITY STATEMENT

The present patent application claims priority from Japanese Patent Application No. 2007-180681 filed on Jul. 10, 2007 in the Japan Patent Office, the entire contents of which are hereby incorporated herein by reference.

BACKGROUND OF THE INVENTION

1. Field of the Invention

Example embodiments generally relate to a fixing device, and more particularly, a fixing device for fixing an image on a recording medium by applying heat and pressure.

2. Description of the Related Art

A related-art image forming apparatus, such as a copier, a printer, a facsimile machine, or a multifunction printer having at least one of copying, printing, scanning, and facsimile functions, typically forms a toner image on a recording medium (e.g., a recording sheet) by electrophotography. Thus, for example, a charging roller uniformly charges a surface of a photoconductor. An optical writer emits a light beam onto the charged surface of the photoconductor according to image data to form an electrostatic latent image on the photoconductor. A development device develops the electrostatic latent image with toner to form a toner image. The toner image is then transferred from the photoconductor onto a recording sheet. Finally, a fixing device applies heat and pressure to the recording sheet bearing the toner image to fix the toner image on the recording sheet, thus forming an image on the recording sheet.

FIGS. 1A, 1B, 1C, and 1D illustrate a fixing device 1R as one example of such fixing device. The fixing device 1R includes a belt 101R, a fixing roller 100R, and a pressing roller 102R. The belt 101R is looped over the fixing roller 100R. The pressing roller 102R presses against the fixing roller 100R through the belt 101R to form a nip between the pressing roller 102R and the fixing roller 100R. When a recording sheet bearing a toner image passes through the nip, the fixing roller 100R and the pressing roller 102R apply heat and pressure to the recording sheet at the nip to fix the toner image on the recording sheet.

Over time, a length of the nip formed between the pressing roller 102R and the fixing roller 100R may vary due to change in diameter and hardness of the pressing roller 102R and the fixing roller 100R over time, resulting in an unstable quality of a fixed toner image.

FIG. 1A illustrates the fixing device 1R in which the fixing roller 100R has a default, normal diameter, and thereby the nip has a default, normal length. The diameter of the fixing roller 100R may change gradually over time or may change due to change in temperature of the fixing roller 100R as an amount of heat applied to the fixing roller 100R changes. For example, the temperature of the fixing roller 100R immediately after the fixing device 1R is warmed up is different from that of the fixing roller 100R after a number of recording sheets has continuously passed through the nip. When the diameter of the fixing roller 100R is changed, the fixing roller 100R has a shorter diameter and thereby the nip has a shorter length as illustrated in FIG. 1B.

FIG. 1C illustrates the fixing device 1R in which the fixing roller 100R has a default, normal hardness, and thereby the nip has a default, normal length. Yet the hardness of the fixing roller 100R may change over time. When the hardness of the fixing roller 100R is decreased, the fixing roller 100R is deformed, thus shortening the nip length as illustrated in FIG. 1D because, for example, when the hardness of an elastic member forming a surface layer of the fixing roller 100R is decreased, a tension applied by the belt 101R may deform portions of the elastic member on both sides near an entrance and an exit of the nip, causing the deformed portions of the elastic member to separate from the pressing roller 102R and thus shortening the nip length.

The change in the length of the nip may in turn cause the amount of heat and pressure applied to a recording sheet passing through the nip to fluctuate, resulting in an unstable quality of a fixed toner image.

Obviously, such unstable quality of a fixed toner image is undesirable, and accordingly, there is a need for a technology to provide a stable quality of a fixed toner image.

SUMMARY

At least one embodiment may provide a fixing device that fixes an image on a recording medium by applying heat and pressure, and includes a belt, a heating roller, a first roller, a belt tensioner, a second roller, a holder, a detector, and a controller. The belt forms a loop. The heating roller is provided inside the loop formed by the belt to apply heat to the belt. The first roller is provided inside the loop formed by the belt to oppose the heating roller. The belt is looped over the heating roller and the first roller. The belt tensioner is provided outside the loop formed by the belt to apply tension to the belt. The second roller presses the first roller via the belt to form a nip between the first roller and the second roller via the belt. The holder holds the first roller and the second roller to maintain a distance between the first roller and the second roller. The detector detects a position of the belt tensioner. The controller changes a control parameter for fixing the image on the recording medium at the nip when the recording medium passes through the nip according to a detection result provided by the detector.

Additional features and advantages of example embodiments will be more fully apparent from the following detailed description, the accompanying drawings, and the associated claims.

BRIEF DESCRIPTION OF THE DRAWINGS

A more complete appreciation of example embodiments and the many attendant advantages thereof will be readily obtained as the same becomes better understood by reference to the following detailed description when considered in connection with the accompanying drawings, wherein.

Figure 1A:
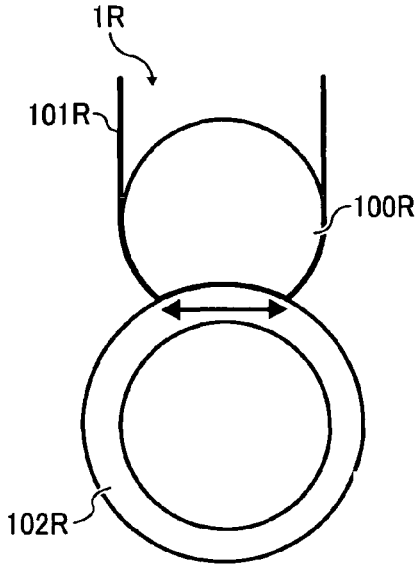
FIG. 1A RELATED ART
FIG. 1A is a sectional view of a related-art fixing device when a fixing roller has a normal diameter.
Figure 1B:
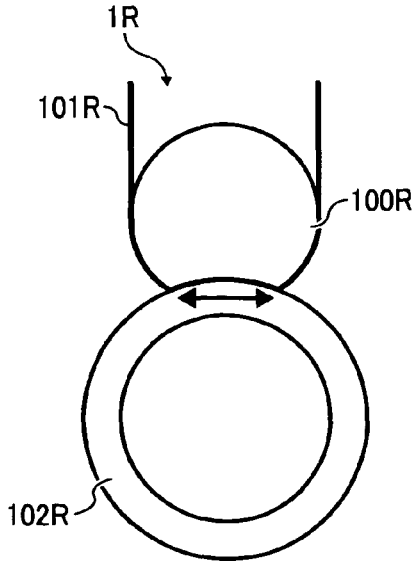
FIG. 1B RELATED ART
FIG. 1B is a sectional view of the related-art fixing device shown in FIG. 1A when the fixing roller shown in FIG. 1A has a shorter diameter.
Figure 1C:
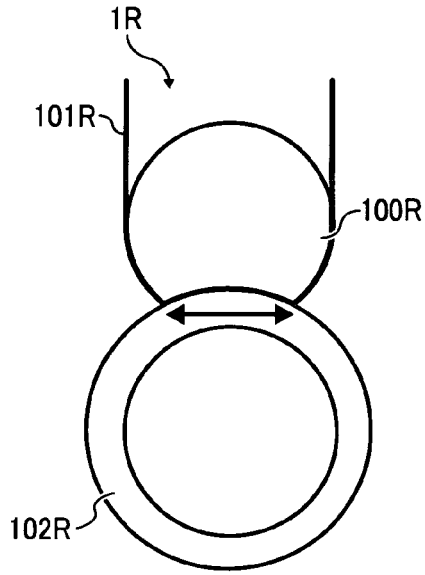
FIG. 1C RELATED ART
FIG. 1C is a sectional view of the related-art fixing device shown in FIG. 1A when the fixing roller shown in FIG. 1A has a normal hardness.
Figure 1D:
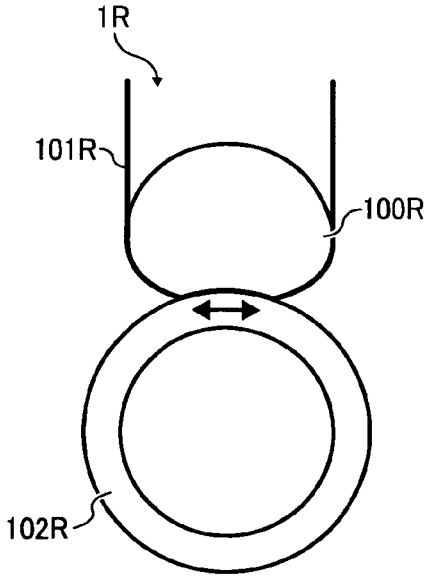
FIG. 1D RELATED ART
FIG. 1D is a sectional view of the related-art fixing device shown in FIG. 1C when the fixing roller shown in FIG. 1C has a smaller hardness.

The accompanying drawings are intended to depict example embodiments and should not be interpreted to limit the scope thereof. The accompanying drawings are not to be considered as drawn to scale unless explicitly noted.

DETAILED DESCRIPTION OF EXAMPLE EMBODIMENTS

It will be understood that if an element or layer is referred to as being "on", "against", "connected to", or "coupled to" another element or layer, then it can be directly on, against, connected or coupled to the other element or layer, or intervening elements or layers may be present. In contrast, if an element is referred to as being "directly on", "directly connected to", or "directly coupled to" another element or layer, then there are no intervening elements or layers present. Like numbers refer to like elements throughout. As used herein, the term "and/or" includes any and all combinations of one or more of the associated listed items.

Spatially relative terms, such as "beneath", "below", "lower", "above", "upper", and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements described as "below" or "beneath" other elements or features would then be oriented "above" the other elements or features. Thus, term such as "below" can encompass both an orientation of above and below. The device may be otherwise oriented (rotated 90 degrees or at other orientations) and the spatially relative descriptors used herein are interpreted accordingly.

Although the terms first, second, etc. may be used herein to describe various elements, components, regions, layers and/or sections, it should be understood that these elements, components, regions, layers and/or sections should not be limited by these terms. These terms are used only to distinguish one element, component, region, layer, or section from another region, layer, or section. Thus, a first element, component, region, layer, or section discussed below could be termed a second element, component, region, layer, or section without departing from the teachings of the present invention.

The terminology used herein is for the purpose of describing particular embodiments only and is not intended to be limiting of the present invention. As used herein, the singular forms "a", "an", and "the" are intended to include the plural forms as well, unless the context clearly indicates otherwise. It will be further understood that the terms "includes" and/or "including", when used in this specification, specify the presence of stated features, integers, steps, operations, elements, and/or components, but do not preclude the presence or addition of one or more other features, integers, steps, operations, elements, components, and/or groups thereof.

In describing example embodiments illustrated in the drawings, specific terminology is employed for the sake of clarity. However, the disclosure of this specification is not intended to be limited to the specific terminology so selected and it is to be understood that each specific element includes all technical equivalents that operate in a similar manner.

Figure 2:
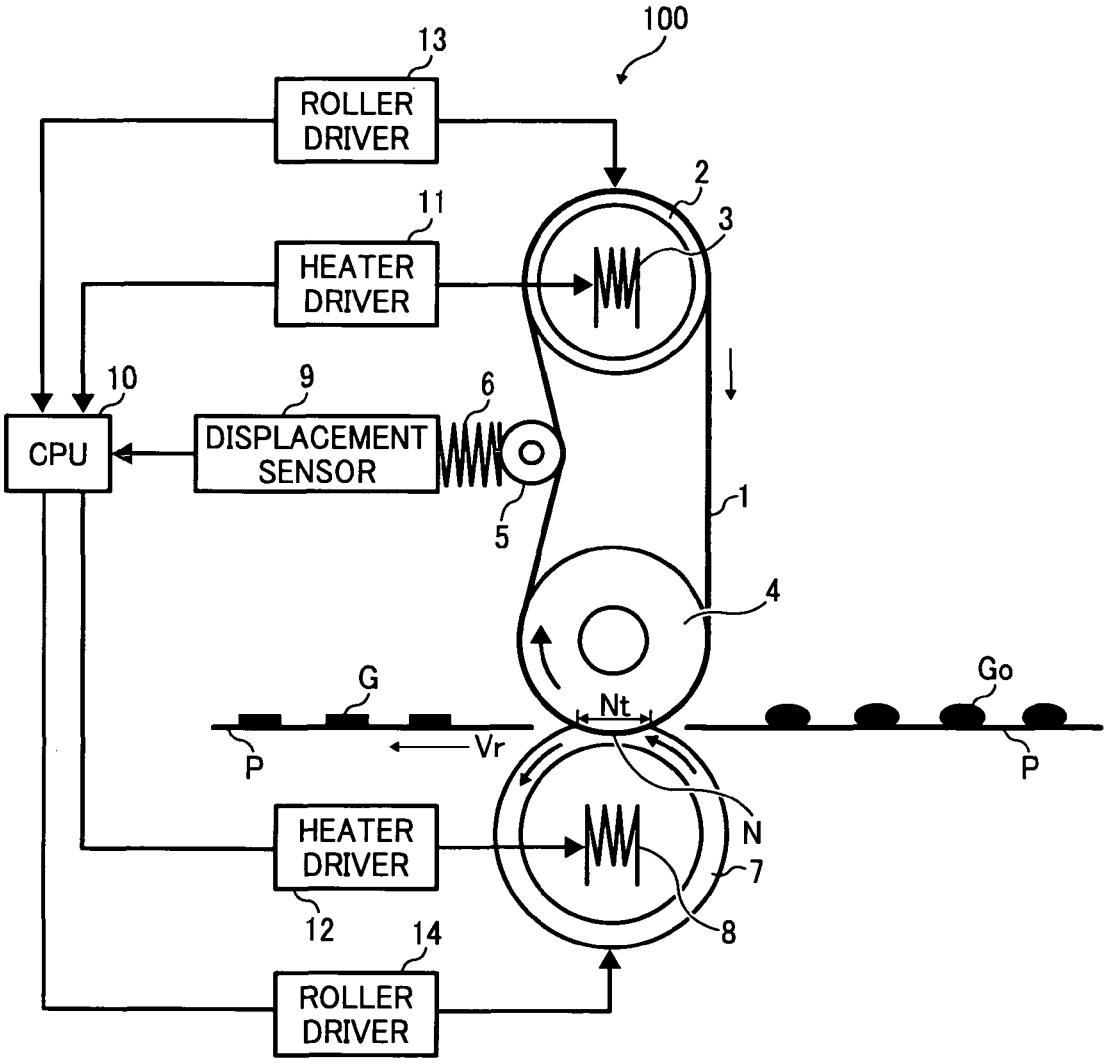
FIG. 2 is a schematic view of a fixing device according to an example embodiment.

Referring now to the drawings, wherein like reference numerals designate identical or corresponding parts throughout the several views, particularly to FIG. 2, a fixing device 100 according to an example embodiment is explained.

FIG. 2 is a schematic view of the fixing device 100. The fixing device 100 includes a fixing belt 1, a heating roller 2, a halogen heater 3, a fixing roller 4, a tension roller 5, a tension spring 6, a pressing roller 7, a halogen heater 8, a displacement sensor 9, a CPU (central processing unit) 10, heater drivers 11 and 12, and/or roller drivers 13 and 14.

The fixing device 100 fixes an unfixed toner image Go on a recording sheet P serving as a recording medium. The fixing belt 1 has an endless belt shape and is looped over the heating roller 2 and the fixing roller 4. The fixing belt 1 includes a releasing layer (e.g., a PFA (perfluoroalkoxy) tube) serving as a surface layer covering a surface of the fixing belt 1. The heating roller 2 includes aluminum and is provided at an upper position inside a loop formed by the fixing belt 1. The halogen heater 3 is provided inside the heating roller 2. The fixing roller 4, serving as a first roller, is provided at a lower position inside the loop formed by the fixing belt 1 and opposes the heating roller 2. The fixing roller 4 includes a surface layer including a silicone rubber foam. The tension roller 5 includes a PFA tube serving as a surface layer covering a surface of the tension roller 5. The tension roller 5, serving as a belt tensioner, is provided outside the loop formed by the fixing belt 1 and receives a force applied by the tension spring 6 so as to apply a tension to the fixing belt 1 looped over the heating roller 2 and the fixing roller 4.

The pressing roller 7, serving as a second roller, presses a lower portion of the fixing roller 4 via the fixing belt 1. The halogen heater 8 is provided inside the pressing roller 7. The pressing roller 7 presses the fixing roller 4 via the fixing belt 1 to form a fixing nip N between the pressing roller 7 and the fixing roller 4 via the fixing belt 1.

The displacement sensor 9, serving as a detector, is provided near the tension roller 5 and includes a laser displacement sensor. The displacement sensor 9 detects an amount of displacement of the tension roller 5, that is, an amount of engagement of the tension roller 5 with the fixing belt 1.

The CPU 10 serves as a controller for controlling operations of elements of the fixing device 100. According to this example embodiment, the CPU 10 receives a detection result sent from the displacement sensor 9, performs a computation, and controls the halogen heaters 3 and 8 via the heater drivers 11 and 12, respectively, and the fixing roller 4 and the pressing roller 7 via the roller drivers 13 and 14, respectively, according to the detection result.

Figure 3A:
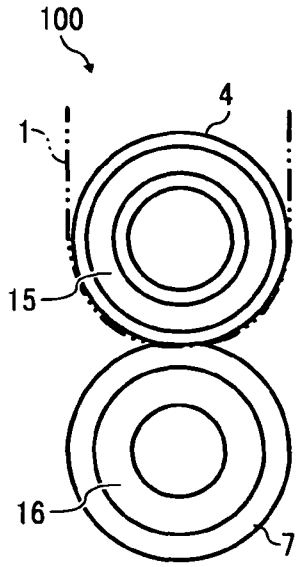
FIG. 3A is an enlarged sectional view (according to an example embodiment) of the fixing device shown in FIG. 2.

FIG. 3A is an enlarged sectional view of the fixing device 100. The fixing device 100 further includes bearings 15 and 16. FIG. 3A illustrates the pressing roller 7 pressing the fixing roller 4. The bearings 15 and 16 are provided at ends of the fixing roller 4 and the pressing roller 7, respectively.

Figure 3B:
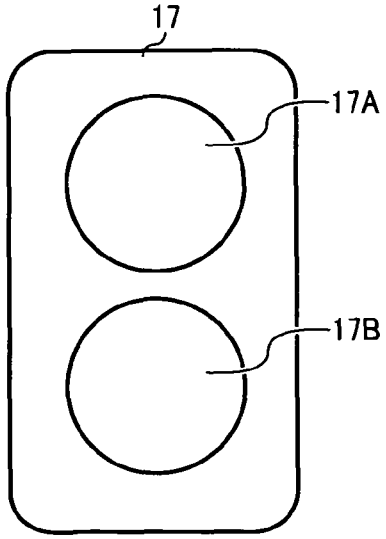
FIG. 3B is a schematic view (according to an example embodiment) of a bearing holder included in the fixing device shown in FIG. 3A.

FIG. 3B illustrates a bearing holder 17 included in the fixing device 100 (depicted in FIG. 3A). The bearing holder 17 includes holes 17A and 17B. The bearing holder 17, serving as a holder, has a plate shape. The holes 17A and 17B are provided in the bearing holder 17 and hold the bearings 15 and 16, respectively. Thus, a distance between a center of the fixing roller 4 and a center of the pressing roller 7 is maintained constant.

As illustrated in FIG. 2, the fixing device 100 is installed in a part of an image forming apparatus (not shown), such as a copier, a printer, or a facsimile machine. When the image forming apparatus is powered on, the CPU 10 sends a driving signal to the heater drivers 11 and 12 to cause the halogen heaters 3 and 8 to generate heat, respectively, so that a temperature of the fixing nip N reaches a reference fixing temperature. The CPU 10 also sends a driving signal to the roller drivers 13 and 14 to rotate the fixing roller 4 and the pressing roller 7, respectively. Accordingly, the rotating fixing belt 1, the rotating fixing roller 4, and the rotating pressing roller 7 move and convey a recording sheet P at a reference linear speed at the fixing nip N.

An appropriate fixing temperature and an appropriate linear speed of the fixing roller 4 and the pressing roller 7 at the fixing nip N are set in advance according to specifications of the fixing device 100 and a developer (e.g., toner) as control parameters for fixing an unfixed toner image Go on a recording sheet P at the fixing nip N, and stored in a memory of the CPU 10.

The pressing roller 7 and the fixing roller 4 sandwich the recording sheet P bearing the unfixed toner image Go at the fixing nip N via the fixing belt 1. The fixing belt 1 and the pressing roller 7 convey the recording sheet P in a reference direction while applying heat and pressure to the recording sheet P to fix the unfixed toner image Go on the recording sheet P so as to form a fixed toner image G.

The CPU 10 receives a detection result showing the amount of displacement of the tension roller 5, that is, the amount of engagement of the tension roller 5 with the fixing belt 1 sent from the displacement sensor 9. The CPU 10 changes (e.g., adjusts) the control parameters for fixing the unfixed toner image Go on the recording sheet P at the fixing nip N when the recording sheet P passes through the fixing nip N according to the detection result.

Referring to FIG. 2, the following describes the control parameters for fixing. A nip length Nt represents a length of the fixing nip N formed between the pressing roller 7 and the fixing roller 4 via the fixing belt 1 in a conveyance direction of the recording sheet P. A linear speed Vr represents a speed at which the fixing roller 4 and the pressing roller 7 rotate to convey the recording sheet P at the fixing nip N. A nip time T represents a time period needed for the recording sheet P to pass through the fixing nip N. The hip time T is calculated by a following formula (1).

$$T=Nt/Vr \quad (1)$$

Figure 4:
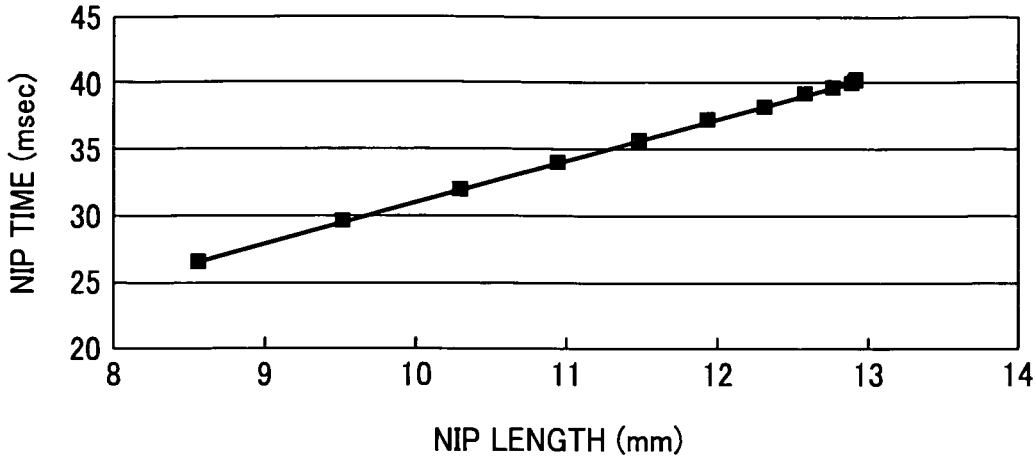
FIG. 4 is a graph (according to an example embodiment) showing a relation between a nip length and a nip time of the fixing device shown in FIG. 2.

FIG. 4 illustrates a relation between the nip length Nt and the nip time T. When the nip length Nt becomes shorter, the nip time T becomes shorter. Namely, the recording sheet P passes through the fixing nip N for a shorter time period. Therefore, a higher fixing temperature is needed to fix the unfixed toner image Go on the recording sheet P properly.

Figure 5:
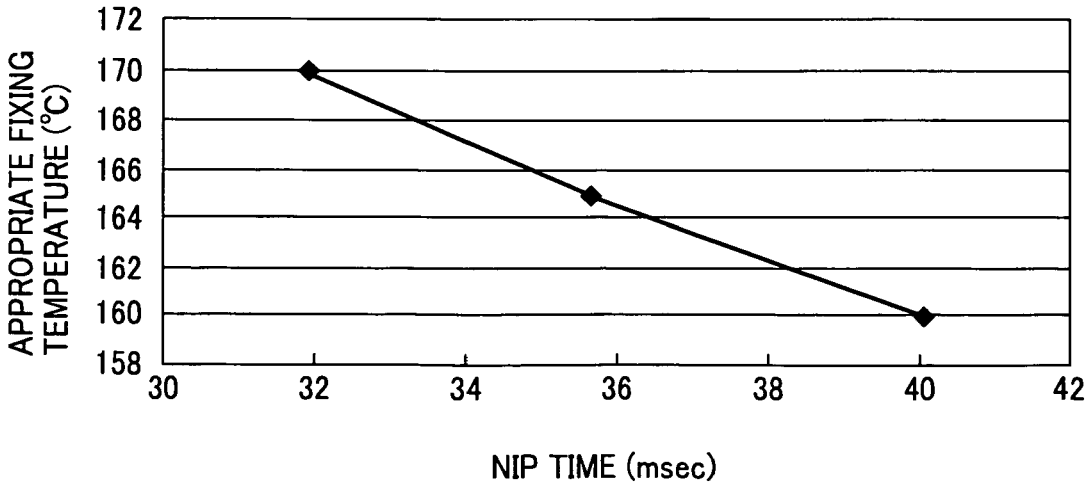
FIG. 5 is a graph (according to an example embodiment) showing a relation between a nip time and an appropriate fixing temperature of the fixing device shown in FIG. 2.

FIG. 5 illustrates a relation between the nip time T and the appropriate fixing temperature. When the nip time T becomes shorter, that is, when the nip length Nt becomes shorter, the appropriate fixing temperature needs to become higher.

When the nip length Nt is changed, for example, when the nip length Nt becomes shorter than a preset appropriate length, the fixing temperature at the fixing nip N when the recording sheet P passes through the fixing nip N needs to be adjusted to a temperature higher than a preset appropriate temperature.

When the nip length Nt becomes shorter than the preset appropriate length, the linear speed Vr may be adjusted to a speed lower than a preset appropriate speed. Accordingly, the recording sheet P passes through the fixing nip N for a time period longer than a time period for which the recording sheet P passes through the fixing nip N having the appropriate nip length Nt. Thus, a reference amount of heat for fixing may be secured when the recording sheet P passes through the fixing nip N.

As illustrated in FIG. 2, according to this example embodiment, the displacement sensor 9 detects the amount of displacement of the tension roller 5 to detect change in the nip length Nt of the fixing nip N. The CPU 10 adjusts the control parameters for fixing, such as the fixing temperature and the linear speed Vr, according to a detection result.

Figure 6:
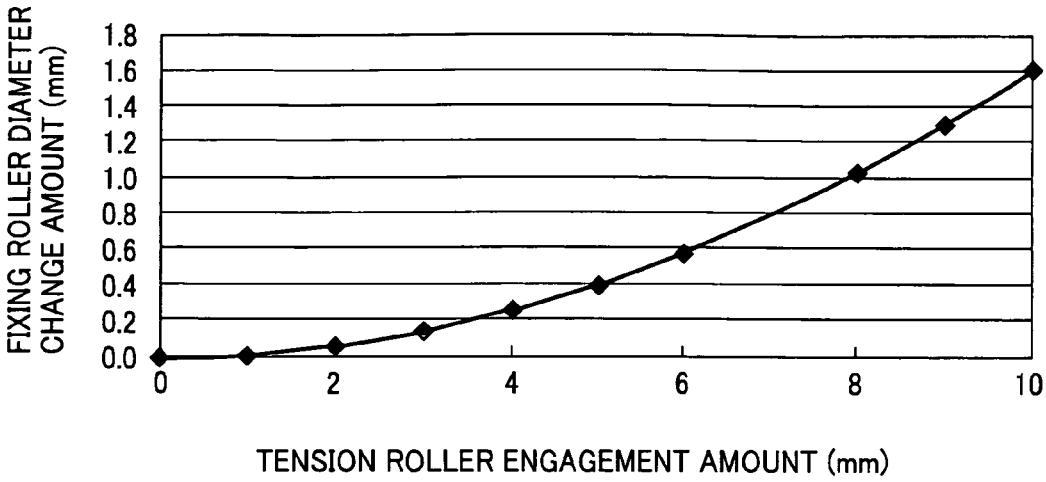
FIG. 6 is a graph (according to an example embodiment) showing a relation between an amount of engagement of a tension roller with a fixing belt and an amount of change in diameter of a fixing roller included in the fixing device shown in FIG. 2.

For example, when a hardness of a sponge roller serving as the fixing roller 4 decreases, the fixing roller 4 is subject to a pressure applied by the tension roller 5 via the fixing belt 1. Consequently, the fixing roller 4 is lifted upward. FIG. 6 illustrates a relation between the amount of engagement of the tension roller 5 with the fixing belt 1 (e.g., the amount of displacement of the tension roller 5) and an amount of change in diameter of the fixing roller 4. When the amount of engagement of the tension roller 5 with the fixing belt 1 increases, the amount of change in diameter of the fixing roller 4 wound by the fixing belt 1 increases. Accordingly, the diameter of the fixing roller 4 decreases.

Figure 7:
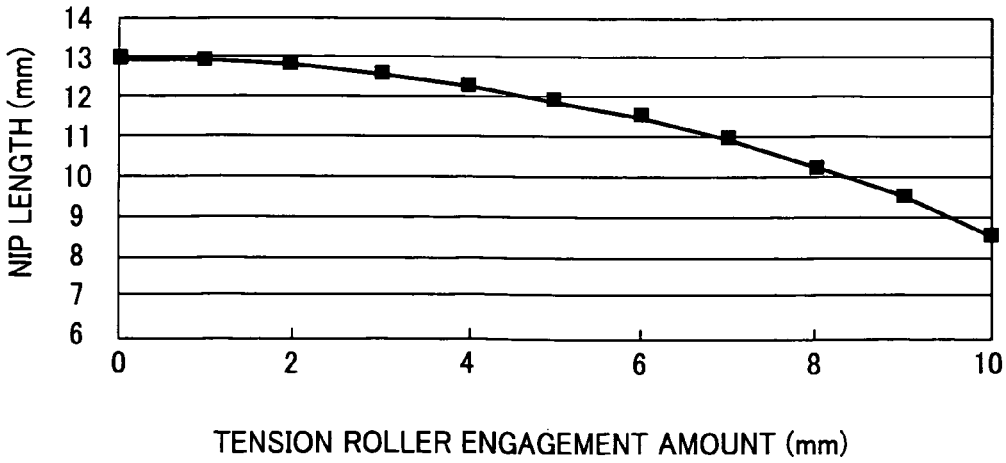
FIG. 7 is a graph (according to an example embodiment) showing a relation between an amount of engagement of a tension roller with a fixing belt included in the fixing device shown in FIG. 2 and a nip length of the fixing device.

According to this example embodiment, the bearing holder 17 (depicted in FIG. 3B) holds the fixing roller 4 and the pressing roller 7. Therefore, as illustrated in FIG. 7 showing a relation between the amount of engagement of the tension roller 5 with the fixing belt 1 and the nip length Nt, when the amount of the engagement of the tension roller 5 with the fixing belt 1 increases, the amount of engagement of the fixing roller 4 with the pressing roller 7 decreases. Consequently, the nip length Nt becomes shorter.

To address this problem, the displacement sensor 9 detects the amount of displacement of the tension roller 5. Thus, the displacement sensor 9 may detect change in the nip length Nt at the fixing nip N properly.

The CPU 10 stores data about the appropriate fixing temperature or the appropriate linear speed of the fixing roller 4 and the pressing roller 7 corresponding to the amount of displacement of the tension roller 5 as the control parameters for fixing at the fixing nip N. When the CPU 10 receives a detection result showing the amount of engagement of the tension roller 5 with the fixing belt 1 sent from the displacement sensor 9, the CPU 10 controls at least one of the fixing temperature at the fixing nip N and the linear speed of the fixing roller 4 and the pressing roller 7, so that a proper amount of heat is applied to the fixing nip N.

The CPU 10 adjusts the control parameters for fixing an unfixed toner image Go on a recording sheet P at the fixing nip N when the recording sheet P passes through the fixing nip N. Thus, a constant amount of heat may be applied to the fixing nip N, so as to form a high-quality fixed toner image G on the recording sheet P.

Figure 8:
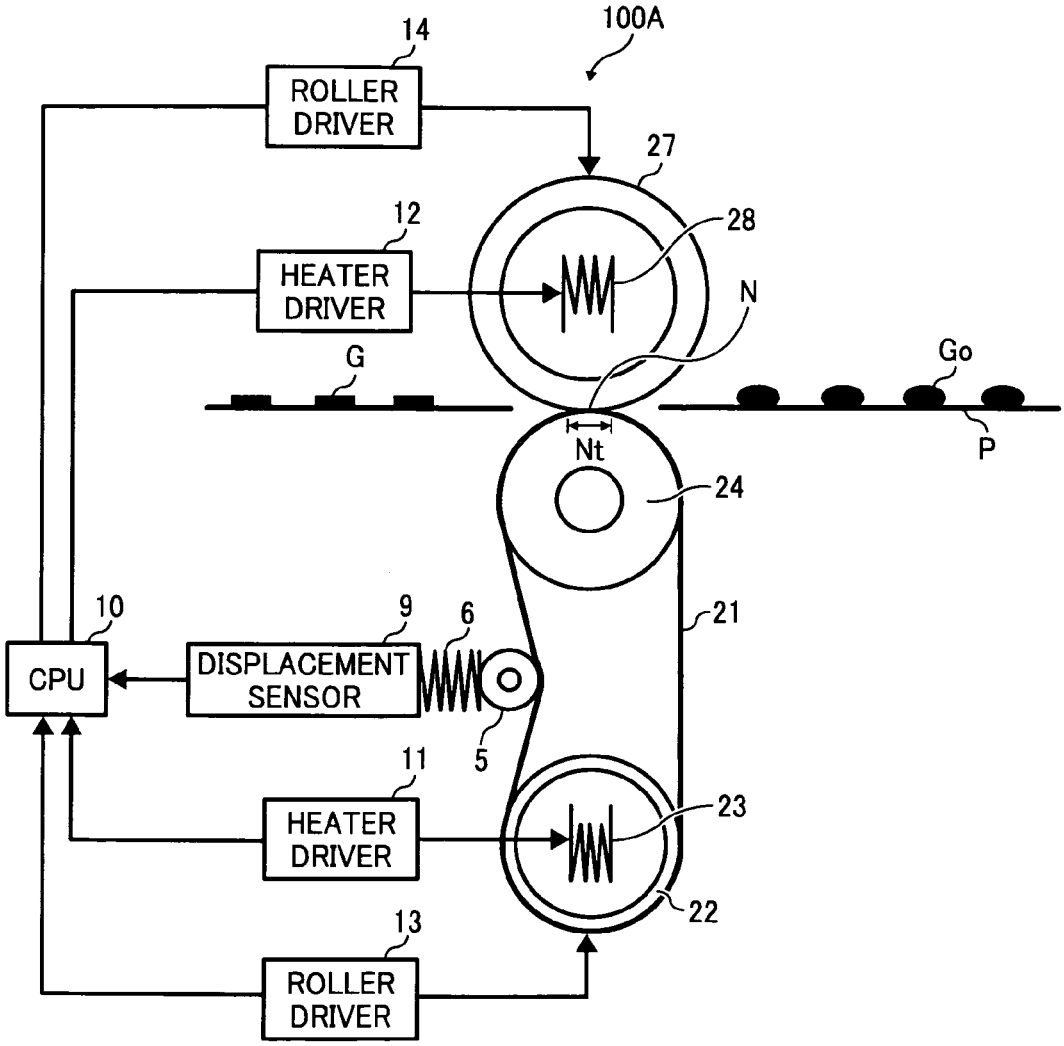
FIG. 8 is a schematic view of a fixing device according to another example embodiment.

Referring to FIG. 8, the following describes a fixing device 100A according to another example embodiment. The fixing device 100A includes a pressing belt 21, a heating roller 22, a halogen heater 23, a pressing roller 24, a fixing roller 27, and/or a halogen heater 28. The other elements of the fixing device 100A are common to the fixing device 100 depicted in FIG. 2.

The fixing device 100A fixes an unfixed toner image Go on a recording sheet P to form a fixed toner image G on the recording sheet P. The pressing belt 21 has an endless belt shape and is looped over the heating roller 22 and the pressing roller 24. The fixing belt 21 includes a releasing layer (e.g., a PFA (perfluoroalkoxy) tube) as a surface layer coveting a surface of the pressing belt 21. The heating roller 22 includes aluminum and is provided at a lower position inside a loop formed by the pressing belt 21. The halogen heater 23 is provided inside the heating roller 22. The pressing roller 24, serving as a first roller, is provided at an upper position inside the loop formed by the pressing belt 21 and opposes the heating roller 22. The pressing roller 24 includes a surface layer including a silicone rubber foam. The fixing roller 27, serving as a second roller, presses an upper portion of the pressing roller 24 via the pressing belt 21. The halogen heater 28 is provided inside the fixing roller 27. The fixing roller 27 presses the pressing roller 24 via the pressing belt 21 to form a fixing nip N between the fixing roller 27 and the pressing roller 24.

In the fixing device 100A, like in the fixing device 100, the bearing holder 17 (depicted in FIG. 3B) holds the pressing roller 24 and the fixing roller 27 in such a manner that a distance between a center of the pressing roller 24 and a center of the fixing roller 27 is maintained constant.

The displacement sensor 9 detects the amount of displacement of the tension roller 5. Thus, the displacement sensor 9 may detect change in a nip length Nt at the fixing nip N properly. When the CPU 10 receives a detection result showing the amount of engagement of the tension roller 5 with the pressing belt 21 sent from the displacement sensor 9, the CPU 10 controls at least one of the fixing temperature at the fixing nip N and the linear speed at which the pressing roller 24 and the fixing roller 27 rotate, so that a proper amount of heat is applied to the fixing nip N. Thus, a constant amount of heat may be applied to the fixing nip N, so as to form a high-quality fixed toner image G on a recording sheet P.

The following describes example experiments 1 and 2 for explaining control parameters for fixing an unfixed toner image Go on a recording sheet P at the fixing nip N when the recording sheet P passes through the fixing nip N.

The example experiment 1 uses the fixing device 100 depicted in FIG. 2. For example, a sponge roller having a diameter of 40 mm is used as the fixing roller 4. The pressing roller 7 has a diameter of 40 mm. An amount of heat needed for fixing may vary depending on type of a developer (e.g., toner) used for forming an unfixed toner image Go. The example experiment 1 uses toner providing a proper fixing quality at a nip time T of 40 msec and a temperature of 160 degrees centigrade. The nip time T is obtained by dividing the nip length Nt by the linear speed Vr at which the fixing roller 4 and the pressing roller 7 rotate.

Tables 1 and 2 below show an amount of displacement of the tension roller 5 and a control parameter adjusted according to the amount of displacement of the tension roller 5. A fixing temperature is adjusted as the control parameter. When the amount of displacement of the tension roller 5 is in a range of from 0 mm to 5.0 mm, the fixing temperature is set to 160 degrees centigrade as a normal temperature. When the amount of displacement of the tension roller 5 is in a range of from 5.1 mm to 8.0 mm and the nip length Nt is decreased, the fixing temperature is increased to a fixing temperature A (e.g., 165 degrees centigrade) according to the decreased nip length Nt. When the amount of displacement of the tension roller 5 is not shorter than 8.1 mm and the nip length Nt is further decreased, the fixing temperature is further increased to a fixing temperature B (e.g., 170 degrees centigrade) according to the decreased nip length Nt. Thus, the fixing temperature B is higher than the fixing temperature A.

TABLE 1

| Amount of displacement of tension roller | Control parameter | |
|---|---|---|
| From 0 mm to 5.0 mm | Normal temperature | |
| From 5.1 mm to 8.0 mm | Fixing temperature A | A < B |
| Not shorter than 8.1 mm | Fixing temperature B | |

TABLE 2

| Amount of displacement of tension roller | Fixing temperature |
|---|---|
| From 0 mm to 5.0 mm | 160° C. |
| From 5.1 mm to 8.0 mm | 165° C. |
| Not shorter than 8.1 mm | 170° C. |

The example experiment 2 also uses the fixing device 100 used in the example experiment 1. Tables 3 and 4 below show an amount of displacement of the tension roller 5 and a control parameter adjusted according to the amount of displacement of the tension roller 5. A linear speed at which the fixing roller 4 and the pressing roller 7 rotate to convey a recording sheet P is adjusted as the control parameter. When the amount of displacement of the tension roller 5 is in a range of from 0 mm to 5.0 mm, the linear speed is set to 323 mm/sec as a normal speed. When the amount of displacement of the tension roller 5 is in a range of from 5.1 mm to 8.0 mm and the nip length Nt is decreased, the linear speed is decreased to a linear speed A (e.g., 286 mm/sec) according to the decreased nip length Nt. When the amount of displacement of the tension roller 5 is not shorter than 8.1 mm and the nip length Nt is further decreased, the linear speed is further decreased to a linear speed B (e.g., 244 mm/sec) according to the decreased nip length Nt. Thus, the linear speed B is slower than the linear speed A.

TABLE 3

| Amount of displacement of tension roller | Control parameter | |
|---|---|---|
| From 0 mm to 5.0 mm | Normal speed | |
| From 5.1 mm to 8.0 mm | Linear speed A | A > B |
| Not shorter than 8.1 mm | Linear speed B | |

TABLE 2

| Amount of displacement of tension roller | Linear speed |
|---|---|
| From 0 mm to 5.0 mm | 323 mm/sec |
| From 5.1 mm to 8.0 mm | 286 mm/sec |
| Not shorter than 8.1 mm | 244 mm/sec |

The example experiments 1 and 2 verify that adjustment of the control parameter may stably provide formation of a high-quality fixed toner image G.

The values of the control parameters shown in Tables 1 to 4 are also applicable to the fixing device 100A depicted in FIG. 8.

The above-described example embodiments may be applied to a fixing device using a belt fixing method installed in an image forming apparatus, such as a copier, a facsimile machine, a printer, a plotter, or a multifunction printer having at least one of copying, printing, scanning, plotter, and facsimile functions, or the like.

According to the above-described example embodiments, in a fixing device (e.g., the fixing device 100 depicted in FIG. 2 or the fixing device 100A depicted in FIG. 8), a heating roller (e.g., the heating roller 2 depicted in FIG. 2 or the heating roller 22 depicted in FIG. 8) is provided in a loop formed by a belt (e.g., the fixing belt 1 depicted in FIG. 2 or the pressing belt 21 depicted in FIG. 8) to apply heat to the belt. A first roller (e.g., the fixing roller 4 depicted in FIG. 2 or the pressing roller 24 depicted in FIG. 8) is provided in the loop formed by the belt, and opposes the heating roller. A belt tensioner (e.g., the tension roller 5 depicted in FIG. 2 or 8) is provided outside the loop formed by the belt and applies tension to the belt looped over the heating roller and the first roller. A second roller (e.g., the pressing roller 7 depicted in FIG. 2 or the fixing roller 27 depicted in FIG. 8) presses the first roller via the belt to form a nip (e.g., the fixing nip N depicted in FIG. 2 or 8) between the first roller and the second roller via the belt. Heat and pressure are applied to a recording medium (e.g., a recording sheet P depicted in FIG. 2 or 8) bearing a toner image (e.g., an unfixed toner image Go depicted in FIG. 2 or 8) to fix the toner image on the recording medium.

A holder (e.g., the bearing holder 17 depicted in FIG. 3B) maintains a constant distance between the first roller and the second roller. A detector (e.g., the displacement sensor 9 depicted in FIG. 2 or 8) detects a position of the belt tensioner. A controller (e.g., the CPU 10 depicted in FIG. 2 or 8) changes a control parameter for fixing the toner image on the recording medium at the nip formed between the first roller and the second roller when the recording medium passes through the nip according to a detection result sent by the detector.

The holder may prevent change in an amount of engagement between the first roller and the second roller due to change in hardness of the first roller and the second roller. Further, the belt tensioner may precisely detect change in a nip length (e.g., the nip length Nt depicted in FIG. 2 or 8) due to change in hardness or diameter of the first roller and the second roller. Thus, the controller may change a fixing temperature and a linear speed of the first roller and the second roller as control parameters for fixing at the nip formed between the first roller and the second roller based on the detection result. As a result, the fixing device may provide a stable quality of a fixed toner image properly.

The controller changes the fixing temperature at the nip formed between, the first roller and the second roller when the recording medium passes through the nip according to the detection result. Thus, even when the first roller and the second roller are displaced or deformed, the fixing device may fix a toner image on the recording medium at an appropriate temperature.

When the belt tensioner is displaced from a preset position and excessively engaged with the belt, the controller determines that the nip length is shorter than an appropriate length due to a decreased hardness or diameter of the first roller. Accordingly, the controller increases the fixing temperature when the recording medium passes through the nip to secure a proper amount of heat. Thus, the fixing device may provide a stable quality of a fixed toner image.

The controller changes the linear speed of the first roller and the second roller at the nip when the recording medium passes through the nip according to the detection result provided by the detector. Thus, even when the first roller and the second roller are displaced or deformed, the fixing device may fix a toner image on the recording medium moving at an appropriate speed.

When the belt tensioner is displaced from a preset position and excessively engaged with the belt, the controller determines that the nip length is shorter than an appropriate length due to a decreased hardness or diameter of the first roller. Accordingly, the controller decreases the linear speed at which the recording medium moves through the nip to secure a proper amount of heat. Thus, the fixing device may provide a stable quality of a fixed toner image.

The present invention has been described above with reference to specific example embodiments. Nonetheless, the present invention is not limited to the details of example embodiments described above, but various modifications and improvements are possible without departing from the spirit and scope of the present invention. It is therefore to be understood that within the scope of the associated claims, the present invention may be practiced otherwise than as specifically described herein. For example, elements and/or features of different illustrative example embodiments may be combined with each other and/or substituted for each other within the scope of the present invention.

What is claimed is:

1. A fixing device for fixing an image on a recording medium by applying heat and pressure, comprising:

a belt to form a loop;

a heating roller provided inside the loop formed by the belt to apply heat to the belt;

a first roller provided inside the loop formed by the belt to oppose the heating roller, the belt looped over the heating roller and the first roller;

a belt tensioner provided outside the loop formed by the belt and positioned to press against and apply tension to the belt from outside the belt to adjust the tension of the belt;

a second roller to press against the first roller via the belt to form a nip between the first roller and the second roller via the belt;

a holder to hold the first roller and the second roller to maintain a distance between the first roller and the second roller;

a detector to detect a position of the belt tensioner; and a controller to change a control parameter for fixing the image on the recording medium at the nip when the recording medium passes through the nip according to a detection result provided by the detector.

2. The fixing device according to claim 1, wherein the control parameter is a fixing temperature.

3. The fixing device according to claim 2, wherein the controller increases the fixing temperature when the belt tensioner is displaced from a preset position to a position at which the belt tensioner is more engaged with the belt.

4. The fixing device according to claim 1, wherein the control parameter is a linear speed at which the first roller and the second roller rotate and convey the recording medium at the nip.

5. The fixing device according to claim 4, wherein the controller decreases the linear speed when the belt tensioner is displaced from a preset position to a position at which the belt tensioner is more engaged with the belt.

6. The fixing device according to claim 1, wherein the belt includes a releasing layer as a surface layer.

7. The fixing device according to claim 1, wherein the first roller includes an elastic layer as a surface layer.

8. The fixing device according to claim 1, wherein the second roller includes a releasing layer as a surface layer.

9. A fixing device for fixing an image on a recording medium by applying heat and pressure, comprising:

a belt to form a loop;

a heating roller provided inside the loop formed by the belt to apply heat to the belt;

a first roller provided inside the loop formed by the belt to oppose the heating roller, the belt looped over the heating roller and the first roller;

a belt tensioner to apply tension to the belt;

a second roller to press against the first roller via the belt to form a nip between the first roller and the second roller via the belt;

a detector to detect a position of the belt tensioner; and a controller to change a control parameter for fixing the image on the recording medium at the nip when the recording medium passes through the nip according to a detection result provided by the detector.

10. The fixing device according to claim 9, wherein the control parameter is a fixing temperature.

11. The fixing device according to claim 10, wherein the controller increases the fixing temperature when the belt tensioner is displaced from a preset position to a position at which the belt tensioner is more engaged with the belt.

12. The fixing device according to claim 9, wherein the control parameter is a linear speed at which the first roller and the second roller rotate and convey the recording medium at the nip.

13. The fixing device according to claim 12, wherein the controller decreases the linear speed when the belt tensioner is displaced from a preset position to a position at which the belt tensioner is more engaged with the belt.

14. The fixing device according to claim 9, wherein the belt includes a releasing layer as a surface layer.

15. The fixing device according to claim 9, wherein the first roller includes an elastic layer as a surface layer.

16. The fixing device according to claim 9, wherein the second roller includes a releasing layer as a surface layer.

17. An image forming apparatus comprising the fixing device according to claim 9.

18. The fixing device according to claim 9, wherein the belt and the first roller convey the recording medium in a reference direction while applying the heat and pressure to the recording medium to fix the image on the recording medium.

19. The fixing device according to claim 9, wherein the detection result is based on an amount of engagement of the belt tensioner with the belt.

20. The fixing device according to claim 9, wherein the control parameter is a fixing temperature and a linear speed at which the first roller and the second roller rotate and convey the recording medium at the nip.

* * * * *